US007500924B2

(12) United States Patent
Yokota

(10) Patent No.: US 7,500,924 B2
(45) Date of Patent: Mar. 10, 2009

(54) GOLF CLUB HEAD

(75) Inventor: Masatoshi Yokota, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 0 days.

(21) Appl. No.: 11/544,045

(22) Filed: Oct. 6, 2006

(65) Prior Publication Data

US 2007/0117648 A1 May 24, 2007

(30) Foreign Application Priority Data

Nov. 22, 2005 (JP) ..... 2005-337466

(51) Int. Cl.
*A63B 53/04* (2006.01)

(52) U.S. Cl. ..... 473/332; 473/346

(58) Field of Classification Search ..... 473/324, 473/327–329, 332, 345–346
See application file for complete search history.

(56) References Cited

U.S. PATENT DOCUMENTS 5,935,020 A * 8/1999 Stites et al. ..... 473/345
D413,952 S * 9/1999 Oyer ..... D21/752
D482,090 S * 11/2003 Burrows ..... D21/752
D501,036 S * 1/2005 Burrows ..... D21/752
D552,198 S * 10/2007 Schweigert et al. ..... D21/752

FOREIGN PATENT DOCUMENTS

JP 07-163685 A 6/1995

* cited by examiner

*Primary Examiner*—Stephen L. Blau
(74) *Attorney, Agent, or Firm*—Birch, Stewart, Kolasch & Birch, LLP

(57) ABSTRACT

A hollow golf club head comprises a face portion whose front face defines a club face for striking a golf ball, a sole portion intersecting the club face at the lower edge thereof, at least one groove being provided on an outer surface of the sole portion, the groove extending in a v-shaped formation whose corner portion is smoothly bended and protrudes toward a leading edge of the head, the groove having a ratio (W/L) of a length w in its front-rear direction to a length L in its toe-heel direction being from 0.20 to 1.50 at least partially, and a distance between the leading edge and the corner of the groove being in the range. of from 5 to 30 mm in the front-rear direction.

7 Claims, 9 Drawing Sheets

GOLF CLUB HEAD

BACKGROUND OF THE INVENTION

1. Field of the Invention

The present invention relates to a golf club head, and more particularly to a golf club head which can improve durability and a ball hitting feeling by improving its sole portion.

2. Description of the Related Art

In recent years, an enlargement of volume is advanced in a hollow golf club head, particularly a wood type club head such as a driver. In accordance with the enlargement of volume in the head, the tendency making thin of a face portion or a crown portion of the club head is increasing. This causes a reduction of its durability of the club head. Particularly, since the face portion is frequently brought into contact with a golf ball, it is necessary to secure a higher durability.

In accordance with various experimentations, the inventors have found that a deformation (a strain) of-the face portion at a time of hitting a ball is suppressed by increasing a durability of its sole portion forming a bottom surface of the club head and supporting the face portion in a lower side, and a durability of the face portion is improved.

On the other hand, if the rigidity is increased, for example, by increasing a thickness of the sole portion, there is a tendency that an impact force at a time of hitting the ball is not sufficiently absorbed by the sole portion so as to be largely transmitted to hands of a golf player. This impresses a hard ball hitting feeling on the player, and is not preferable.

SUMMARY OF THE INVENTION

A main object of the present invention is to provide a golf club head which can improve the durability and a ball hitting feeling, on the basis of a structure in which a V-shaped groove is provided in the sole portion.

According to the present invention, a hollow golf club head comprises a face portion whose front face defines a club face for striking a golf ball, a sole portion intersecting the club face at the lower edge thereof, at least one groove being provided on an outer surface of the sole portion, the groove extending in a V-shaped formation whose corner portion is smoothly bended and protrudes toward a leading edge of the head, the groove having a ratio (W/L) of a length w in its front-rear direction to a length L in its toe-heel direction being from 0.20 to 1.50 at least partially, and a distance between the leading edge and the corner of the groove being in the range of from 5 to 30 mm in the front-rear direction.

DESCRIPTION OF THE PREFERRED EMBODIMENTS

Embodiments of the present invention will now be described in detail in conjunction with the accompanying drawings.

Figure 1:
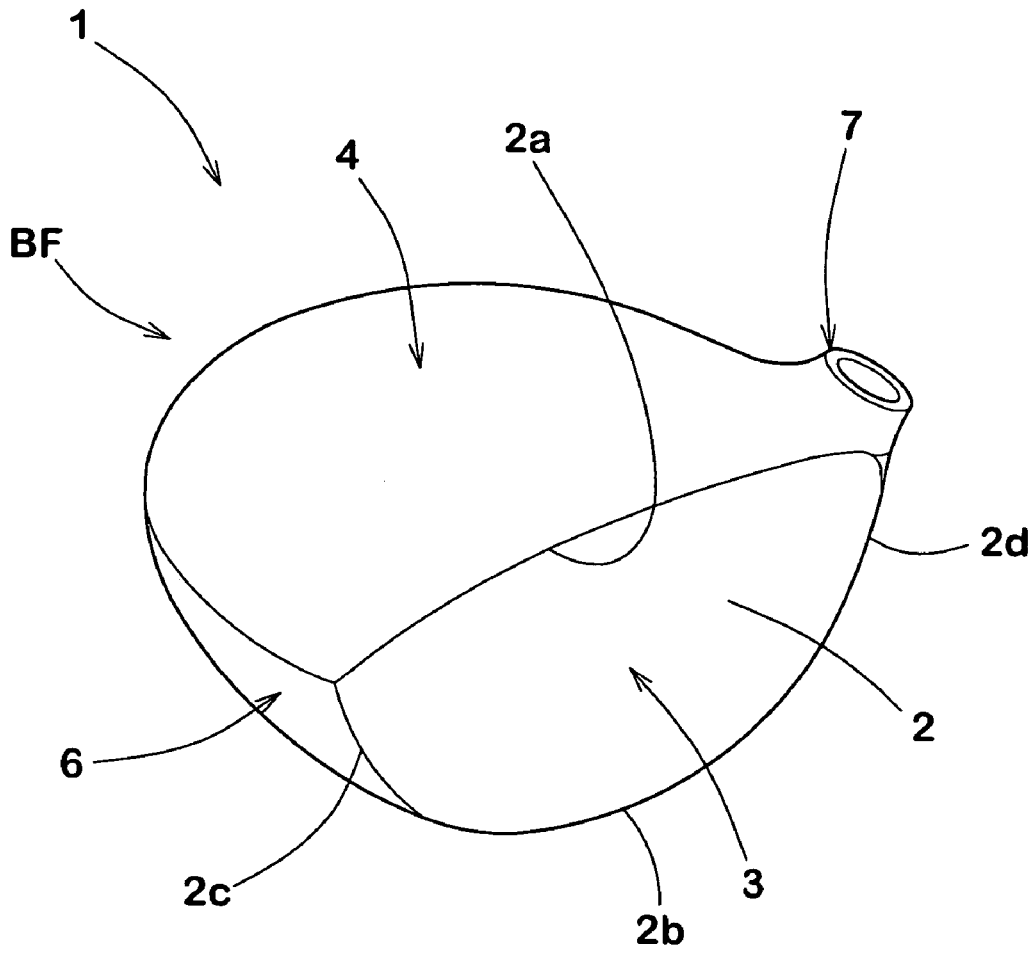
FIG. 1 is a perspective view of a club head in a standard condition showing an embodiment in accordance with the present invention.
Figure 2:
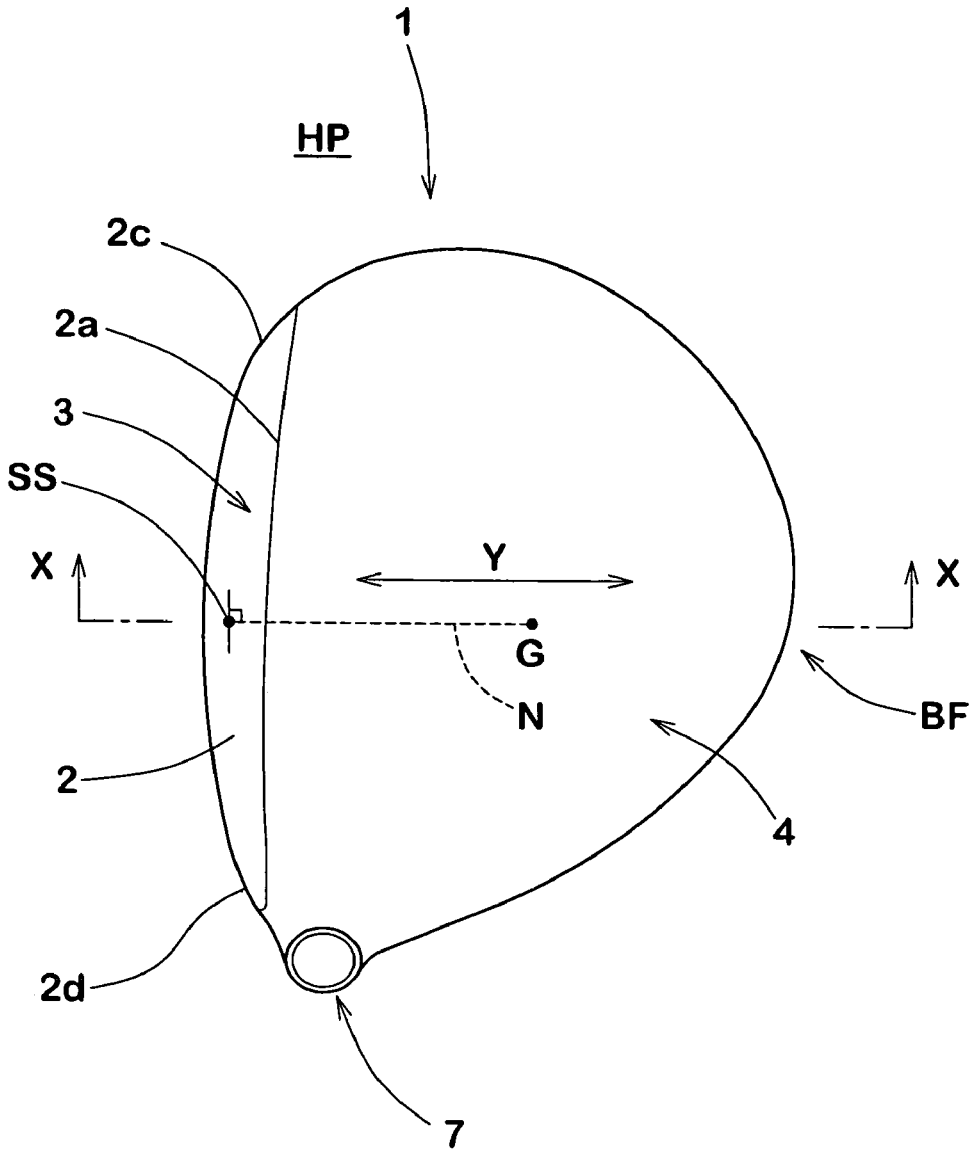
FIG. 2 is a plan view of FIG. 1.
Figure 3:
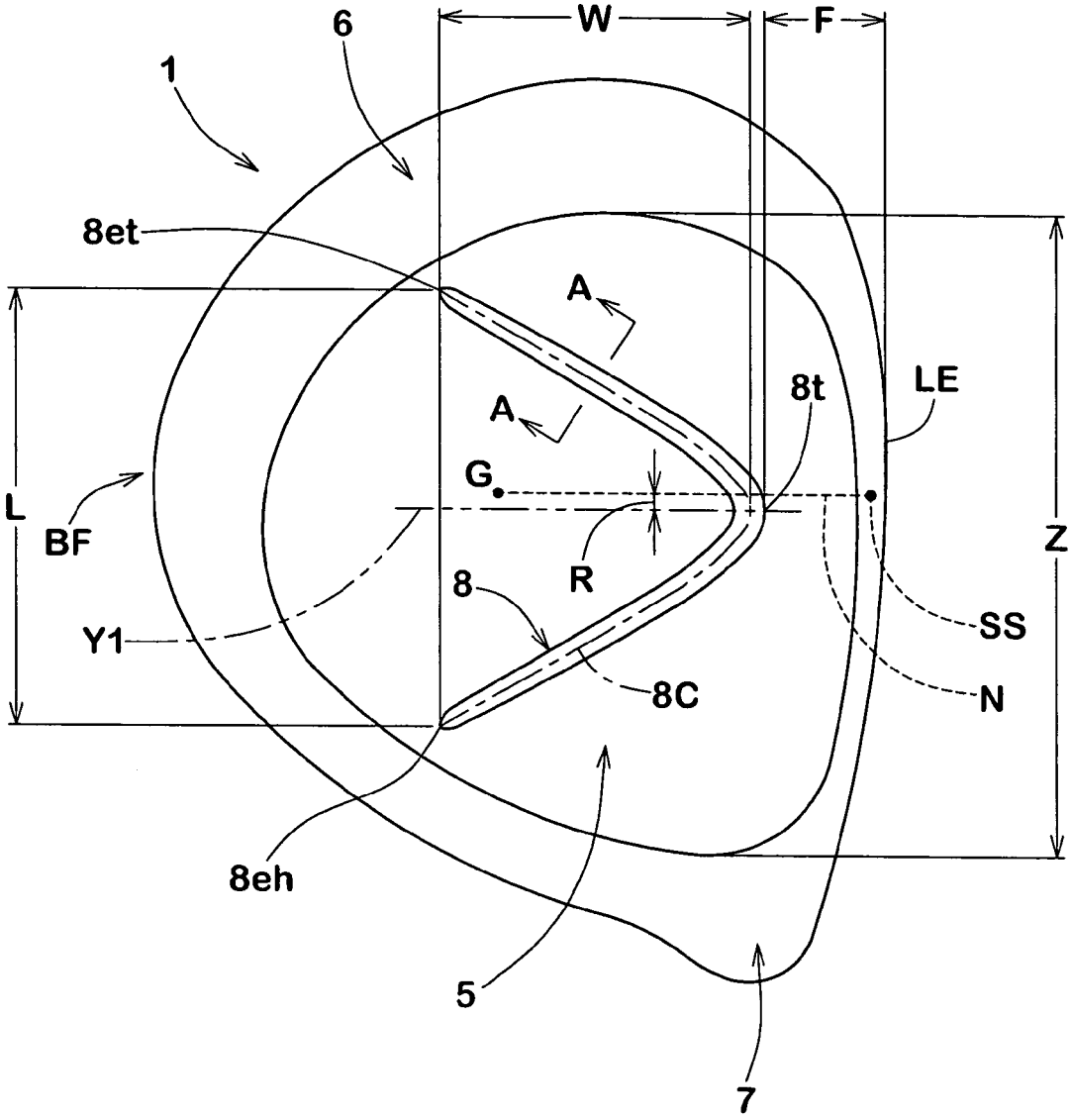
FIG. 3 is an enlarged bottom view of FIG. 1.

FIGS. 1 to 3 show a standard condition in which a golf club head 1 according to the present embodiment is grounded on a horizontal plane HP at its lie angle and its loft angle (real loft). In the drawings, the club head 1 according to the present invention is a hollow wood-type club head such as #1 driver and fairway wood having a cavity i therein.

The club head 1 comprises: a face portion 3 whose front face defines a club face 2 for hitting a ball; a crown portion 4 intersecting the club face 2 at the upper edge 2*a* thereof; a sole portion 5 intersecting the club face 2 at the lower edge 2*b* thereof; a side portion 6 between the crown portion 4 and the sole portion 5 which extends from a toe-side edge 2*c* to a heel-side edge 2*d* of the club face 2 through the back face BF of the club head; and a hosel portion 7 to be attached to an end of a club shaft (not shown).

The club head 1 according to the present embodiment has a volume preferably not less than 400 cm3, more preferably not less than 420 cm3, and further preferably not less than 430 cm3. Therefore, it is possible to increase a sweet spot area and a moment of inertia so that the directionality of hit ball is improved. In this case, an upper limit of the volume of the club head 1 is not particularly limited, however, when the volume of the head 1 is too large, some problems like increase of club weight, deterioration of swing balance, a durability fall and a violation of the golf rules may cause. Therefore, the volume of the club head is preferably not more than 470 cm3.

Further, it is desirable that a total weight of the club head 1 is preferably not less than 170 g, and more preferably not less than 180 g, and it is desirable that the upper limit is preferably not more than 250 g, and more preferably not more than 240 g. If the total weight of the club head 1 is too small, a weight of the club head is not felt during the swing and it is hard to align timing, and there is a tendency that a repulsion performance is lowered and a carry becomes small. On the contrary, if the total weight of the club head 1 becomes too large, the club can not be fully swung, so that the carry and a directional stability tend to be lowered.

It is desirable that a material structuring the club head 1 is constituted by a metal material such as a titanium, a titanium alloy, an aluminum alloy, a maraging steel, a stainless steel, a magnesium alloy or the like. Further, in order to optimize a center of gravity of club the head, a fiber reinforced resin may be used in a part of the club head 1.

Figure 4:
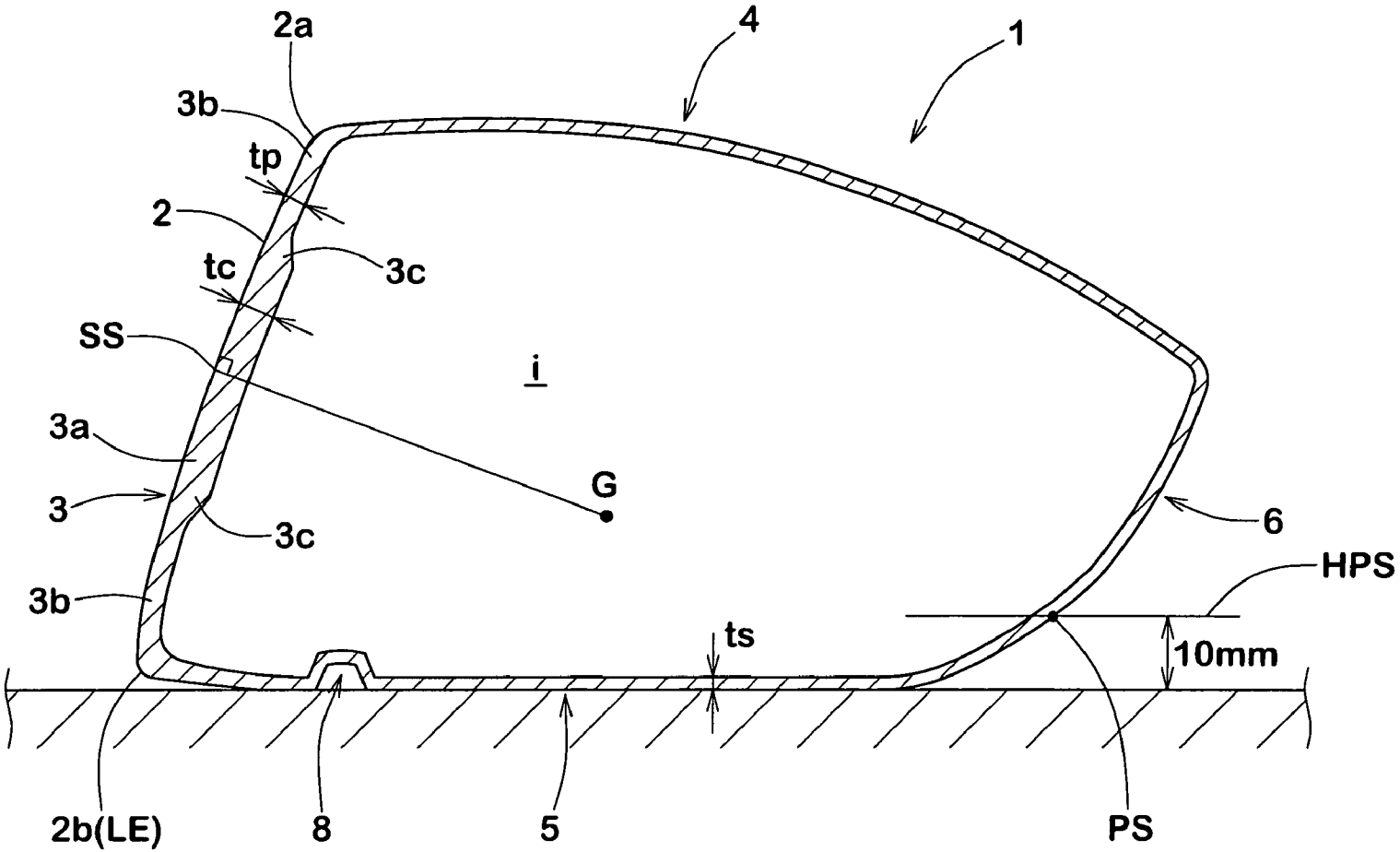
FIG. 4 is a cross sectional view along a line X-X in FIG. 2.

As shown in FIG. 4, the face portion 3, for example, includes a center portion 3*a* having a large thickness tc, and a peripheral thin portion 3*b* extending annularly so as to surround the center portion 3*a* and having a smaller thickness tp than the thickness tc of the center portion 3*a*. In the face portion 3 mentioned above, a strength is maintained by the center portion 3*a* at a time of hitting the ball. Further, it is possible to increase a repulsion coefficient of the club head to the maximum within a golf rule, by largely deflecting the peripheral thin portion 3*b* having the small thickness.

In order to improve the durability and the repulsion performance of the face portion 3, it is desirable that the thickness tc of the center portion 3*a* is preferably not less than 2.0 mm, more preferably not less than 2.3 mm, and further preferably not less than 2.5 mm, and an upper limit thereof is preferably not more than 4.0 mm, more preferably not more than 3.7 mm, and further preferably not more than 3.5 mm. Further, it is desirable that the thickness tp of the peripheral thin portion 3*b* is preferably not less than 1.0 mm, more preferably not less than 1.5 mm, and further preferably not less than 2.0 mm, and an upper limit thereof is preferably not more than 3.5 mm, more preferably not more than 3.3 mm, and further preferably not more than 3.0 mm.

It is desirable that the face portion 3 includes a thickness transition portion 3*c* having a smoothly changed thickness and connecting the center portion 3*a* and the peripheral thin portion 3*b*. The thickness transition portion 3*c* is provided between the center portion 3*a* and the peripheral thin portion 3*b*. Accordingly, it is possible to prevent a stress concentration in a boundary between the center portion 3*a* and the peripheral thin portion 3*b*, and improve the durability of the face portion 3.

The club head 1 according to the present invention is provided with at least one (one in this embodiment) groove 8 concaved to a hollow portion i side in the sole portion 5.

The groove 8 is formed in a smoothly curved V-shape formation in a head bottom view (FIG. 3) in a standard condition, and is formed in such a manner that a corner portion 8*t* thereof protrudes toward a leading edge LE. In other words, the groove 8 includes a toe-side end 8*et* which positions closest to the toe side, a heel-side end 8*eh* which positions closest to the heel side, and the corner portion 8*t* which positions approximately in the middle of the respective ends 8*et* and 8*eh* and closer to the Leading edge LE therefrom, and extends approximately in a V shape so as to join them 8*et*, 8*t* and 8*eh*.

The "leading edge" mentioned above shall be an edge closest to the front side (closest to the face side) in a bottom view in the standard condition. Further, the "V-shaped formation" is not necessarily constituted by a complete V shape, but includes a broad concept including: a shape in which the corner portion of the groove 8 is rounded like a chamfer; and a shape in which whole thereof are formed by an arc. In other words, it is sufficient if it includes a shape obliquely extending in toe and heel directions respectively from the corner 8*t* existing closest to the leading edge LE side.

In the present embodiment, each end 8*et* and 8*eh* of the groove 8 is provided in the sole portion 5. However, the end(s) 8*et* and/or 8*eh* of the groove 8 may be provided so as to extend to the side portion 6. It is desirable that the corner portion 8*t* of the groove 8 is constituted by a smooth circular arc shaped curve. This serves for preventing a stress concentration which tends to be generated in the corner portion 8*t* at a time of hitting the ball.

Figure 5:
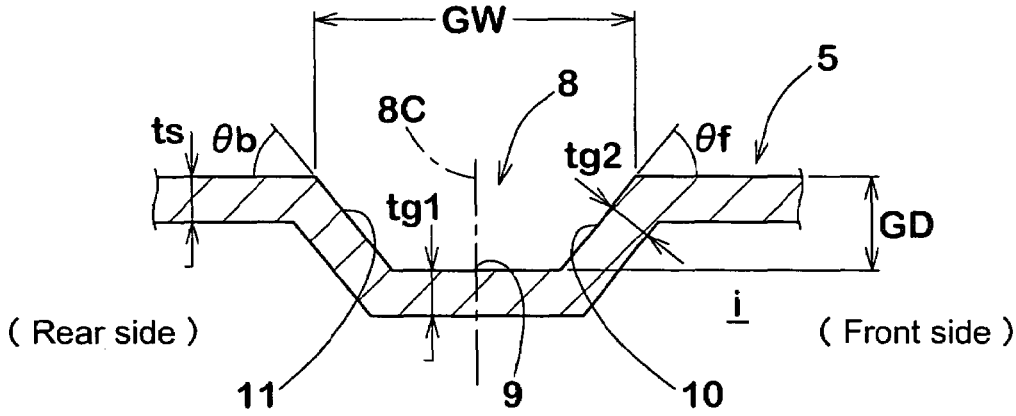
FIG. 5 is a cross sectional view of a groove perpendicular to a center line of the groove, in a cross section along a line A-A in FIG. 3.

As shown in FIG. 5 corresponding to a cross section along a line A-A in FIG. 3, the groove 8 comprises: a bottom 9; a front wall 10 which is connected to a front side of the bottom 9; and a rear wall portion 11 which is connected to a rear side of the bottom 9. Accordingly, the groove 8 has a width GW open in a surface of the sole portion 5, and a depth GD concaved from a surface of the sole portion 5.

Further, as shown in FIG. 3, the groove 8 includes a portion which has a ratio (W/L) of a length w in its front-rear direction to a length L in its toe-heel direction perpendicular to the front-rear direction being from 0.20 to 1.50.

Here, each length W and L is measured on the center line 8C of the groove 8. Further, the "front-rear direction of the club head" is set to a direction Y (as shown in FIG. 2) parallel to a line obtained by projecting a normal line N drawn to the club face 2 from a center of gravity G of the club head on the horizontal plane HP, in the standard condition, as shown in FIG. 2. Further, the "center line of the groove" 8C corresponds to a segment continuously passing through a midpoint of the width GW of the groove. Further, the ratio is determined by projecting the lengths W and L on the horizontal plane HP.

The inventors have known that the rigidity and the impact absorbability of the sole portion 5 can be controlled by changing the ratio (W/L) of the groove 8 provided in the sole portion 5.

Figure 6A:
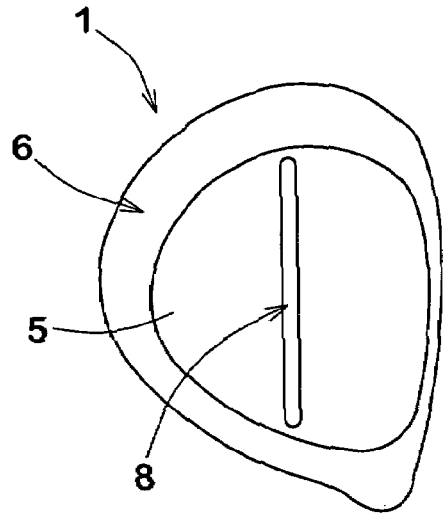
FIGS. 6(A) to 6(C) are bottom views of the club head explaining an effect of the groove.

In other words, if the ratio (W/L) is too small, the groove 8 becomes a flat shape extending along the toe-heel direction, as shown in FIG. 6(A). In the sole portion 5 provided with such a groove, a great deformation in a direction reducing the width tends to be generated in the groove 8 according to an impact force at a time of hitting the ball. Accordingly, in the aspect mentioned above, it is impossible to obtain a sufficient reinforcing effect of the sole portion 5.

Figure 6B:
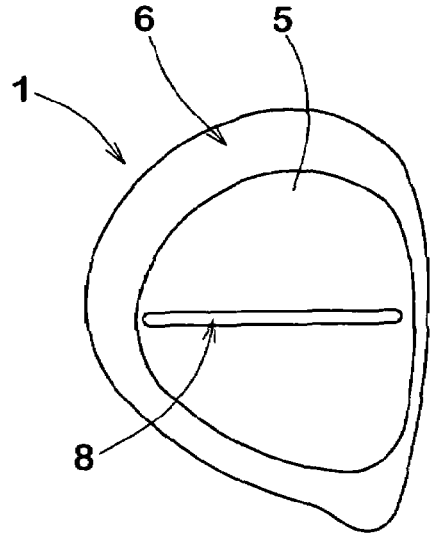

On the other hand, if the ratio (W/L) is too large, the groove 8 becomes a flat shape extending along the front-rear direction Y of the head, for example, as shown in FIG. 6(B). Since the sole portion 5 provided with such a groove 8 exhibits a high rigidity in the front-rear direction of the head, the strain of the sole portion at a time of hitting the ball is restricted small. However, since the rigidity in the toe-heel direction of the sole portion 5 is low, a great deformation around the groove 8 corresponding to a bending center still tends to be generated.

Figure 6C:
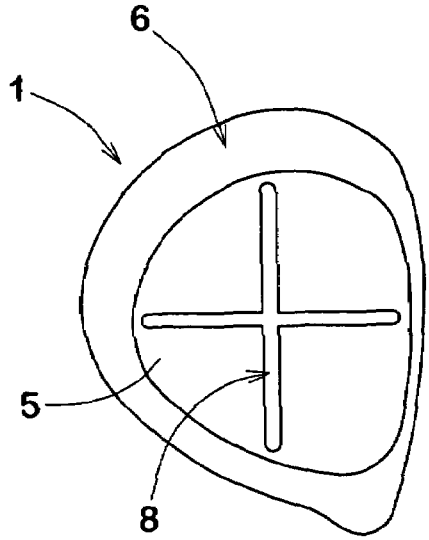

Further, since a groove 8 intersecting like a cross shape in the sole portion 5 as shown in FIG. 6(C) increase a rigidity in both of the front-rear direction and the toe-heel direction too much, the impact (the vibration) at a time of hitting the ball can not be sufficiently absorbed by the sole portion 5. Therefore, the impact force is transmitted as a great vibration to the golf player. As a result, the ball hitting feeling is deteriorated.

In the present invention, taking the above into consideration, the V-shaped groove 8 having the ratio (W/L) in the range of from 0.20 to 1.50 is provided in the sole portion 5. The groove 8 satisfying the ratio (W/L) does not excessively lower the rigidity of the sole portion 5 in the front-rear direction Y of the club head. Accordingly, the strain of the sole portion 5 at a time of hitting the ball is restricted small. Therefore, it is possible to suppress the deformation of the face portion 3 supported by the sole portion 5, and to improve the durability of the face portion 3. Further, since the groove 8 can lower the rigidity of the sole portion 5 in a direction of bending along a straight line Y1 (as shown in FIG. 3) along the front-rear direction Y of the head passing through the corner portion 8*t*, the impact force at a time of hitting the ball is absorbed to the sole portion 5 by utilizing the deformation. Accordingly, the ball hitting feeling is not deteriorated. Further, since the deformation along the straight Y1 line does not cause a great stress at the bottom 9 of the groove 8, there is no risk that the damage or the like is caused starting from the groove 8. Therefore, the club head 1 according to the present embodiment can achieve a high impact absorbing capacity while suppressing the strain of the sole portion 5 at a time of hitting the ball.

From this point of view, it is desirable that the ratio (W/L) is more preferably not less than 0.25, and further preferably not less than 0.53, and it is desirable that the upper limit is preferably not more than 1.40, and further preferably not more than 0.80. In this case, it is sufficient that the groove 8 partly includes the portion satisfying the ratio mentioned above. However, it is preferably not less than 60% of an entire length of the groove 8, and more preferably not less than 80%, and further preferably the entire of the groove 8 satisfies the ratio (W/L) mentioned above.

Further, a distance F in the front-rear direction of the club head between the leading edge LE and the corner portion 8*t* of the groove 8 is set in the range of from 5 to 30 mm.

If the distance F is less than 5 mm, the corner portion 8*t* of the groove 8 comes close to the club face 2, the stress at a time of hitting the ball is concentrated to the corner portion 8*t*, and the damage tends to be generated. On the contrary, if the distance F in more than 30 mm, a great deformation is generated in a region between the leading edge LE and the corner portion 8*t*, and it is impossible to sufficiently achieve the effect of suppressing the deformation of the club face 2. From this point of view, the distance F is more preferably not less than 10 mm, and further preferably not less than 15 mm, and an upper limit thereof is preferably not more than 25 mm, and more preferably not more than 20 mm.

It is desirable that the groove 8 is formed substantially bilateral symmetry with respect to the straight line Y1 extending in the front-rear direction Y of the club head through the corner portion 8*t*. Above all, it is desirable that a displacement R of the straight line Y1 from the normal line N is preferably within 10 mm, and more preferably within 5 mm. Accordingly, it is possible to arrange the corner portion 8*t* of the groove 8 in a region to which the impact force at a time of hitting the ball is applied in a greatest manner, and it is possible to effectively suppress the strain of the sole portion 5. Further, the toe side and the heel side of the sole portion 5 can be reinforced with a good balance.

In order to further improve the rigidity of the sole portion 5, the total length of the groove 8 measured along the center line 8C of the groove 8 is preferably not less than 1.0 time a length Z of the sole portion 5 in the toe-heel direction, more preferably not less than 1.1 times, and further preferably not less than 1.2 times, and an upper limit thereof is preferably not more than 1.6 times, more preferably not more than 1.5 times, and further preferably not more than 1.4 times. In the case that the sole portion 5 can be differentiated from the side portion 6 by the edge, the sole portion 5 is set to the region surrounded by the edge, however, in the case that the edge is unclear, a line PS of intersection between a horizontal plane HPS spaced at 10 mm from the horizontal plane HP in the standard condition and an outer surface of the club head (except the face) is assumed as the edge, as shown in FIG. 4.

Further, as shown in FIG. 5, in a groove cross section perpendicular to the center line 8C of the groove 8, the width GW of the groove 8 is preferably not less than 2 mm, and more preferably not less than 3 mm, and an upper limit thereof is preferably not more than 12 mm, and more preferably not more than 10 mm. Further, in the groove cross section mentioned above, it is desirable that a depth GD of the groove 8 is preferably not less than 0.5 mm, and an upper limit thereof is preferably not more than 2.0 mm.

In the case that the width GW of the groove 8 is less than 2 mm, or in the case that the depth GD is less than 0.5 mm, the reinforcing effect of the sole portion 5 by the groove 8 can not be sufficiently obtained. On the contrary, in the case that the width GW is more than 12 mm, or in the case that the depth GD is more than 2.0 mm, the stress tends to be concentrated to the groove 8, and the damage starting from the groove 8 tends to be generated by extension.

The width GW and/or the depth GD of the groove 8 may be fixed or changed. Above all, in order to relax the stress concentration, it is desirable that the groove 8 includes at least one taper portion at which the width GW and/or the depth GD is smoothly reduced toward the end(s) 8*eh* and/or 8*et* thereof.

The groove 8 according to the present embodiment has a substantially flat bottom 9, and the front wall 10 and the rear wall 11 respectively extending linearly in directions expanding the groove width GW from the bottom 9, as shown in FIG. 5. In order to improve the durability of the bottom 9, it is desirable that a thickness tg1 thereof is identical with a thickness tg2 of each of the walls 10 and 11, or is larger than the thickness tg2. In the present embodiment, the respective thicknesses tg1 and tg2 of the groove 8 are formed substantially the same, and are identical with a thickness t5 of the sole portion 5 except the groove 8.

In order to improve the durability of the sole portion 5, it is desirable that each of the thicknesses tg1, tg2 and t5 is preferably not less than 0.5 mm, more preferably not less than 0.8 mm, and further preferably not less than 1.0 mm. In this case, in order to prevent the weight of the club head from being increased, it is desirable that each of the thicknesses tg1, tg2 and t5 is preferably not more than 2.0 mm.

Further, in the embodiment in FIG. 5, the front wall 10 is inclined to the front side from the bottom 9 toward the outside. An angle of the front wall 10 is expressed by an angle of gradient (an angle between a horizontal line and an extension line of the front wall 10) θf to the front side with respect to the horizontal line. Further, the rear wall 11 is inclined to the rear side from the bottom 9 toward the outside. An angle of the rear wall 11 is expressed by an angle of gradient (an angle between the horizontal line and an extension line of the rear wall 11) θb to the rear side with respect to the horizontal line. The angles θf and θb mentioned above are expressed by an acute angle in the other cases than 90 degrees. Further, the gradient of the walls in the direction enlarging the groove width and 90 degrees are expressed by a positive value.

In order to further increase the rigidity of the sole portion 5, it is desirable that the angles θf and θb are preferably not less than 30 degrees, and more preferably not less than 45 degrees. Further, it is desirable that an upper limit of the angle θf and θb are preferably not more than 90 degrees, more preferably less than 90 degrees, and further preferably not more than 80 degrees. In the case that the angle of gradient is negative, not only the mud or the foreign material tend to be clogged within the groove 8, but also the sole portion 5 tends to be caught on the ground at a time of being brought into contact with the ground during the swing, especially in the rear wall 11. Accordingly, a swinging property tends to be deteriorated. The angle θf or θb of gradient mentioned above may be identical or different.

The cross sectional shape of the groove 8 can be variously modified. For example, in FIG. 7, both of the front wall 10 and the rear wall 11 have the angles θf and θb of gradient being substantially 90 degrees. Accordingly, the groove 8 has an approximately rectangular groove cross section. The groove 8 mentioned above can more effectively increase the rigidity of the sole portion 5 in comparison with the aspect in FIG. 5.

Figure 8:
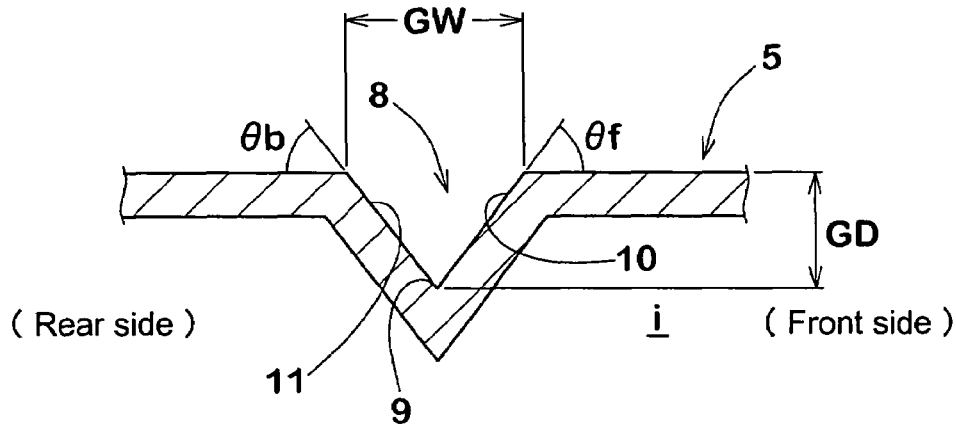
FIG. 8 is a cross sectional view of a groove perpendicular to a center line of the groove, showing the other embodiment.

In the embodiment in FIG. 8, there is shown a groove 8 having an approximately triangular cross section tapered toward the hollow portion i.

Figure 9:
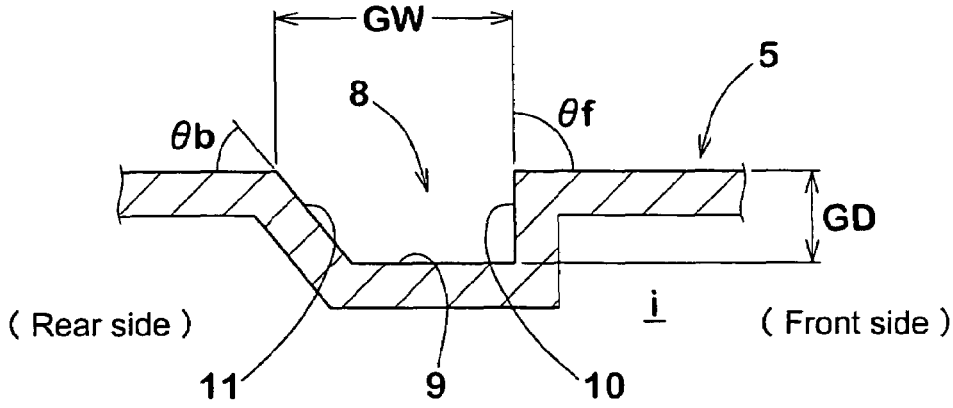
FIG. 9 is a cross sectional view of a groove perpendicular to a center line of the groove, showing the other embodiment.

In an embodiment in FIG. 9, there is shown a groove having a cross section in which the angle θb of gradient of the rear wall 11 is smaller than the angle θf of gradient of the front wall 10. Since the rear wall 11 of the groove 8 has the small angle θb, this groove 8 tends to not catch on the ground in comparison with the aspect in FIG. 7 when the sole portion 5 is brought into contact with the ground during the swing. Further, since the front wall 10 has the larger angle θf in comparison with the rear wall 11, it is possible to effectively increase the rigidity of the groove 8 in comparison with the aspect in FIG. 5. Accordingly, the groove as shown in FIG. 9 has a totally good balance. At this time, it is desirable that a difference (θf-θb) of the angles mentioned above is preferably not less than 10 degrees, and more preferably not less than 20 degrees, and it is desirable that an upper limit thereof is preferably not more than 60 degrees, more preferably not more than 40 degrees, and further preferably not more than 30 degrees.

Figure 10:
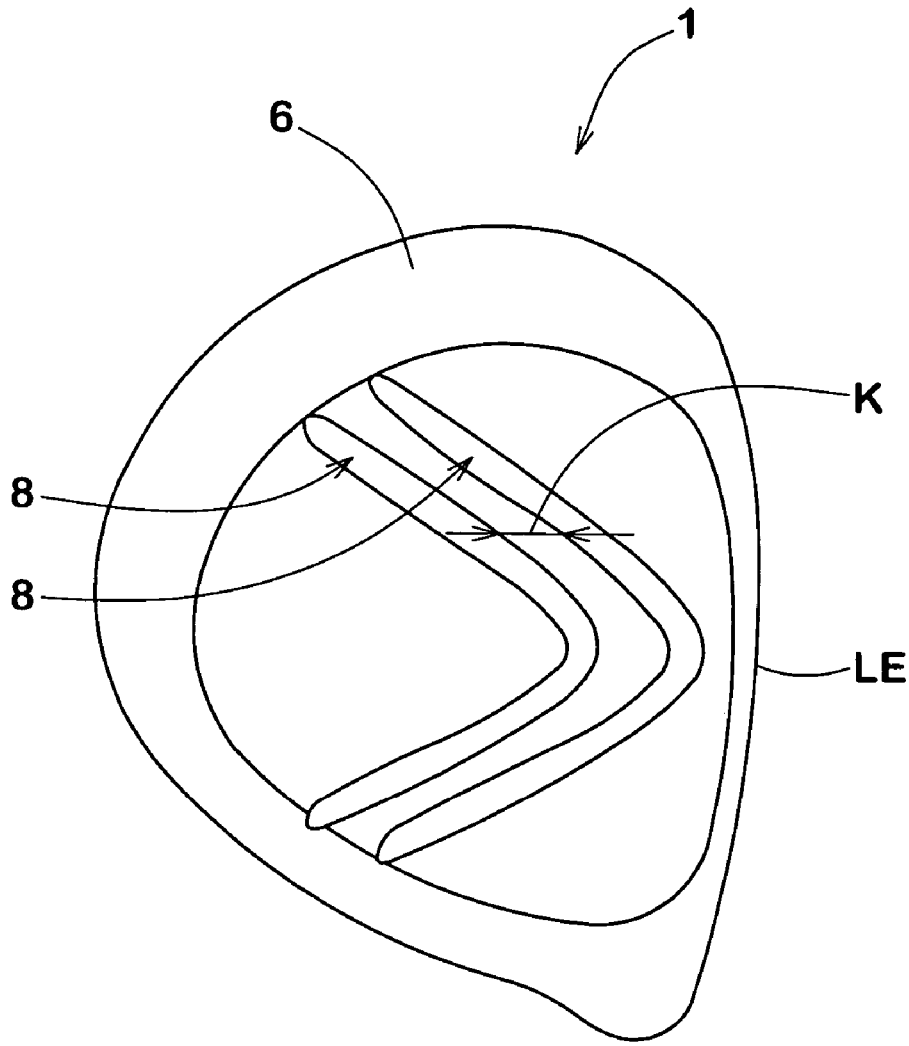
FIG. 10 is a bottom view of a club head, showing the other embodiment.

The description is given above of the embodiments according to the present invention, however, the present invention can be carried out by being modified to various embodiments. For example, as shown in FIG. 10, a plurality of (two in this example) groves 8 may be provided on the sole portion 5. In this case, it is desirable that at least one, preferably all of the grooves are constituted by the groove satisfying the ratio (W/L) mentioned above. Further, in the case that a plurality of grooves 8 are provided, it is desirable that a distance K in the front-rear direction of the club head about from 3 to 10 mm is provided between the grooves 8 and 8, in order to secure the durability of the portion between the grooves 8. Further, the groove 8 may be formed in accordance with a press molding, or may be molded by a forging or a casting.

Comparison Test:

A description will be given of a preferable example according to the present invention. Each of test club heads according to an example and a reference was constituted by a wood type golf club head formed by bonding a face member and a head main body both made of a titanium alloy (Ti-6Al-4V) and having a head volume of 460 $cm^3$. The face member is finished by press molding of Ti-6Al-4V such that a thickness of the center portion is 2.8 mm, and the thickness of the peripheral thin portion is 2.5 mm. Further, a head main body is constituted by a lost wax precision cast product of Ti-6Al-4V, each thickness of the crown portion and the side portion is 0.7 mm, and a thickness of the sole portion is 1.2 mm. In a structure having the groove in the sole portion, the groove was molded by a forging. Respect portions of the groove have the same thickness as the thickness of the sole portion. Further, both the members were bonded in accordance with a carbon dioxide gas laser welding. A concrete specification of the groove of the sole portion is as shown in Table 1.

Next, the durability and the ball hitting feeling were tested about each of the test club heads. The test method is as follows.

Durability Test:

A plurality of wood type hollow golf clubs with a length of 45 inch were manufactured by attaching the same carbon shafts to each of the club heads, and 5000 times ball hitting tests at a head speed of 54 meter/second were performed in all the test clubs by using a swing robot. Then the number of hitting times until any damage was caused in the face portion was counted. The results were indicated as follows.

Very Good: no damage until 5000 balls

Good: damage is generated at number not less than 3000 and less than 5000

Bad: damage is generated at number less than 3000

Ball Hitting Feeling:

Each of ten golfers comprising professional and single handicap players hits five 3-piece golf balls by using the test golf clubs mentioned above, and a number of the golfers feeling "bad (hard) ball hitting feeling" is evaluated on the basis of the following standard. very good: number of golfers feeling bad is not more than 3

Good: number of golfers feeling bad is four or five

Bad: number of golfers feeling bad is not less than 6

Results of the tests are shown in Table 1. From the test results, it was confirmed that the durability and hitting feeling can be improved.

TABLE 1

Figure 7:
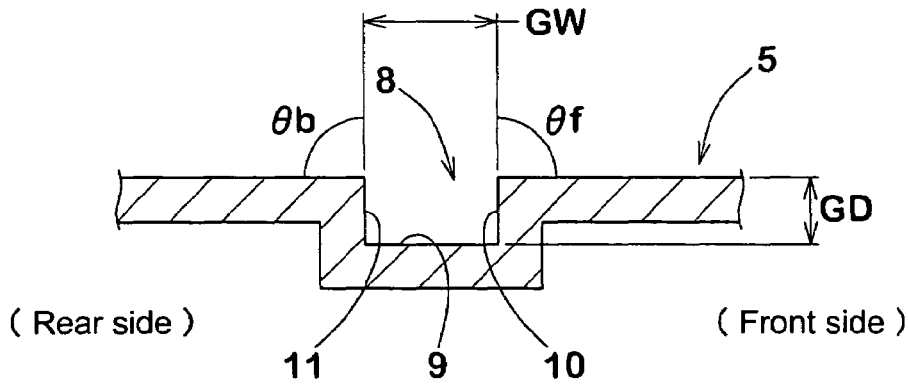
FIG. 7 is a cross sectional view of a groove perpendicular to a center line of the groove, showing the other embodiment.
Figure 11:
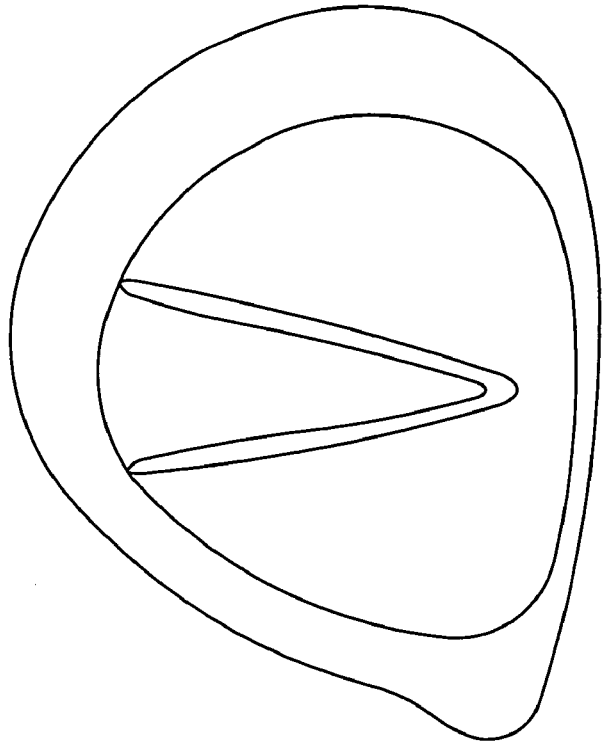
FIG. 11 is a bottom view of a club head, showing a comparative embodiment.
Figure 12:
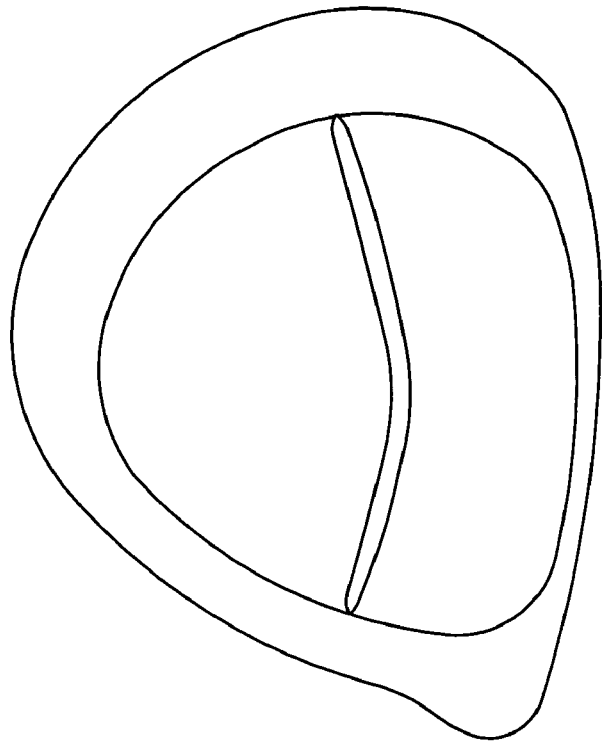
FIG. 12 is a bottom view of a club head, showing a comparative embodiment.

| | Ex. 1 | Ex. 2 | Ex. 3 | Ex. 4 | Ex. 5 | Ex. 6 | Ex. 7 | Ex. 8 | Ex. 9 | Ref. 1 | Ref. 2 | Ref. 3 | Ref. 4 |
|---|---|---|---|---|---|---|---|---|---|---|---|---|---|
| View showing groove shape | FIG. 3 | FIG. 3 | FIG. 3 | FIG. 3 | FIG. 3 | FIG. 3 | FIG. 3 | FIG. 3 | FIG. 3 | FIG. 12 | FIG. 11 | FIG. 6 (A) | FIG. 6 (B) |
| View showing cross section of groove | FIG. 5 | FIG. 5 | FIG. 5 | FIG. 5 | FIG. 5 | FIG. 7 | FIG. 8 | FIG. 5 | FIG. 5 | FIG. 5 | FIG. 5 | FIG. 5 | FIG. 5 |
| Length W [mm] | 40 | 70 | 25 | 40 | 40 | 40 | 40 | 40 | 40 | 10 | 70 | — | — |
| Length L [mm] | 75 | 50 | 100 | 75 | 75 | 75 | 75 | 75 | 75 | 95 | 30 | — | — |
| Ratio (W/L) | 0.53 | 1.40 | 0.25 | 0.53 | 0.53 | 0.53 | 0.53 | 0.53 | 0.53 | 0.11 | 2.33 | — | — |
| Distance F [mm] | 15 | 10 | 25 | 15 | 15 | 15 | 15 | 15 | 15 | 35 | 10 | 50 | 0 |
| Groove width GW [mm] | 8 | 8 | 8 | 1 | 15 | 8 | 8 | 8 | 8 | 8 | 8 | 8 | 8 |
| Groove length [mm] | 120 | 145 | 100 | 120 | 120 | 120 | 120 | 120 | 120 | 100 | 170 | 90 | 90 |
| Angle of front wall θf [deg] | 70 | 70 | 70 | 70 | 70 | 90 | 60 | 45 | 30 | 70 | 70 | 70 | 45 |
| Angle of rear wall θb [deg] | 45 | 45 | 45 | 45 | 45 | 90 | 60 | 45 | 70 | 45 | 45 | 45 | 45 |
| Length of sole portion Z [mm] | 100 | 100 | 100 | 100 | 100 | 100 | 100 | 100 | 100 | 100 | 100 | 100 | 100 |
| Durability (damaged portion) | Very good | Good (Corner portion of grove) | Good (Club Face) | Good (Club Face) | Good (Club Face) | Good (Edge of groove) | Good (Bottom of groove) | Good (Club face) | Good (Club face) | Bad (Club Face) | Bad (Corner portion of grove) | Bad (Club face) | Very good |
| Ball hitting feeling | Very good | Very good | Good | Very good | Good | Very good | Very good | Very good | Very good | Very good | Bad | Very good | Bad |

| | Ref. 5 | Ref. 6 | Ref. 7 | Ref. 8 | Ex. 10 | Ex. 11 |
|---|---|---|---|---|---|---|
| View showing groove shape | FIG. 3 | FIG. 3 | FIG. 3 | FIG. 3 | FIG. 3 | FIG. 3 |
| View showing cross section of groove | FIG. 5 | FIG. 5 | FIG. 5 | FIG. 5 | FIG. 5 | FIG. 5 |

TABLE 1-continued

| | | | | | | |
|---|---|---|---|---|---|---|
| Length W [mm] | 50 | 30 | 13 | 78 | 15 | 74 |
| Length L [mm] | 90 | 70 | 71 | 50 | 70 | 50 |
| Ratio (W/L) | 0.56 | 0.43 | 0.18 | 1.56 | 0.21 | 1.48 |
| Distance F [mm] | 3 | 35 | 15 | 15 | 15 | 15 |
| Groove width GW [mm] | 8 | 8 | 8 | 8 | 8 | 8 |
| Groove length [mm] | 130 | 100 | 85 | 180 | 85 | 175 |
| Angle of front wall θf [deg] | 70 | 75 | 70 | 70 | 70 | 70 |
| Angle of rear wall θb [deg] | 45 | 45 | 45 | 45 | 45 | 45 |
| Length of sole portion Z [mm] | 100 | 100 | 100 | 100 | 100 | 100 |
| Durability (damaged portion) | Bad (Corner portion of grove) | Bad (Club Face) | Bad (Club Face) | Bad (Corner portion of grove) | Good (Club face) | Good (Corner portion of grove) |
| Ball hitting feeling | Very Good | Very good | Very good | Bad | Very good | Good |

The invention claimed is:

1. A hollow golf club head comprising a face portion whose front face defines a club face for striking a golf ball, a sole portion intersecting the club face at the lower edge thereof, at least one groove being provided in an outer surface of the sole portion, the groove extending in a V-shaped formation whose corner portion is smoothly bended and protrudes toward a leading edge of the head, the groove having a ratio (W/L) of a length W in its front-rear direction to a length L in its toe-heel direction being from 0.20 to 1.50, and a distance between the leading edge and the corner portion of the groove being in the range of from 5 to 30 mm in the front-rear direction, wherein the groove has a width in the range of from 2 to 12 mm and a depth in the range of from 0.5 to 2.0 mm, and the length of the groove measured along the center line thereof is in the range of from 1.0 to 1.6 times the maximum dimension of the sole portion measured along the toe-heel direction.

2. The golf club head according to claim 1, wherein the groove comprises a bottom, a front wall being connected to the front side of the bottom and a rear wall being connected to the rear side of the bottom, and each thickness of the bottom, the front wall and the rear wall is substantially the same.

3. The golf club head according to claim 1, wherein the groove comprises a bottom, a front wall being connected to the front side of the bottom and a rear wall being connected to the rear side of the bottom, and in a cross section of the groove, an inclined angle of the front wall with respect to the horizontal line is greater than the angle of the rear wall.

4. The golf club head according to claim 3, wherein the angles of the front and rear walls are in the range of from 30 to 90 degrees, and the difference (θf-θb) between the angles θf of the front wall and the angle θb of the rear wall is in the range of from 20 to 60 degrees.

5. The golf club head according to claim 1, wherein the groove has a bilateral symmetry formation with respect to a straight line extending in the front-rear direction through a top of the corner portion thereof.

6. The golf club head according to claim 5, wherein a displacement of the straight line from a normal line which is drawn to the club face from a center of gravity of the club head is within 10mm in a bottom view of the club head.

7. The golf club head according to claim 1, wherein the length of the groove measured along the center line thereof is in the range of from 1.2 to 1.6 times the maximum dimension of the sole portion in the toe-heel direction.

* * * * *